US008912420B2

(12) United States Patent
Seyfer et al.

(10) Patent No.: US 8,912,420 B2
(45) Date of Patent: Dec. 16, 2014

(54) ENHANCING MUSIC

(71) Applicants: Amanda Seyfer, Berkeley, CA (US); Joshua Pollack, San Francisco, CA (US)

(72) Inventors: Amanda Seyfer, Berkeley, CA (US); Joshua Pollack, San Francisco, CA (US)

(73) Assignee: Miselu, Inc., Mountain View, CA (US)

( * ) Notice: Subject to any disclaimer, the term of this patent is extended or adjusted under 35 U.S.C. 154(b) by 0 days.

(21) Appl. No.: 13/754,253

(22) Filed: Jan. 30, 2013

(65) Prior Publication Data

US 2014/0208921 A1 Jul. 31, 2014

(51) Int. Cl.
*G10H 1/36* (2006.01)
*G10H 7/00* (2006.01)
*G10H 1/00* (2006.01)

(52) U.S. Cl.
CPC ..... *G10H 1/0033* (2013.01)
USPC ..... 84/634

(58) Field of Classification Search
CPC ..... G10H 1/0025; G10H 2210/145; G10H 2210/111
USPC ..... 84/609, 634
See application file for complete search history.

(56) References Cited

U.S. PATENT DOCUMENTS

| | | | | |
|---|---|---|---|---|
| 6,124,543 | A * | 9/2000 | Aoki | 84/609 |
| 6,175,072 | B1 * | 1/2001 | Aoki | 84/636 |
| 6,308,086 | B1 * | 10/2001 | Yoshino | 455/567 |
| 6,528,715 | B1 * | 3/2003 | Gargi | 84/615 |
| 7,026,535 | B2 * | 4/2006 | Eruera | 84/609 |
| 2001/0045154 | A1 * | 11/2001 | Aoki | 84/609 |
| 2006/0230909 | A1 * | 10/2006 | Song et al. | 84/609 |
| 2006/0230910 | A1 * | 10/2006 | Song et al. | 84/616 |

* cited by examiner

*Primary Examiner* — Jeffrey Donels
(74) *Attorney, Agent, or Firm* — Trellis IP Law Group, PC

(57) ABSTRACT

Embodiments generally relate to enhancing music. In one embodiment, a method includes receiving a sound input, extracting a primary melody from the sound input, and converting the primary melody into a graphical representation. The method also includes generating a plurality of derivative melodies, where each derivative melody is derived from the primary melody. The method also includes enabling a user to select one or more of the derivative melodies to be played with the primary melody.

20 Claims, 7 Drawing Sheets

700

100

300

400

500

600

700

ENHANCING MUSIC

BACKGROUND

The creation of music is a popular activity enjoyed by many people. Some music applications enable a user to create music. Many music applications have a substantial number of features that require a steep learning curve on the part of the user. Some music applications have prerecorded popular melodies, and allow the user to select such melodies to play.

SUMMARY

Embodiments generally relate to enhancing music. In one embodiment, a method includes receiving a sound input, extracting a primary melody from the sound input, and converting the primary melody into a graphical representation. The method also includes generating a plurality of derivative melodies, where each derivative melody is derived from the primary melody. The method also includes enabling a user to select one or more of the derivative melodies to be played with the primary melody.

In another embodiment, an apparatus includes one or more processors, and includes logic encoded in one or more tangible media for execution by the one or more processors. When executed, the logic is operable to perform operations including receiving a sound input, extracting a primary melody from the sound input, and converting the primary melody into a graphical representation. The logic is further operable to perform operations including generating a plurality of derivative melodies, where each derivative melody is derived from the primary melody. The logic is further operable to perform operations including enabling a user to select one or more of the derivative melodies to be played with the primary melody.

DETAILED DESCRIPTION OF EMBODIMENTS

Embodiments described herein enable a user to produce pleasant musical compositions through the use of a set of simple tools. In some embodiments, a processor receives a sound input such as a tune sung by a user or an audio file (e.g., song clip, etc.) provided by the user. The processor then extracts a seed or primary melody from the sound input, and converts the primary melody into a graphical representation. The processor then generates a plurality of enhancements to the primary melody. Such enhancements are referred to as derivative melodies, where each derivative melody is derived from the primary melody. The processor enables the user to select one or more of the derivative melodies to be played with the primary melody.

As a result, the user has the experience of producing pleasant music without the need for significant training. Embodiments provide the user with a sense of creativity through a manageable list of enhancements. A short list of enhancements provide a manageable scope of enhancement options for the user to enhance music.

Figure 1:
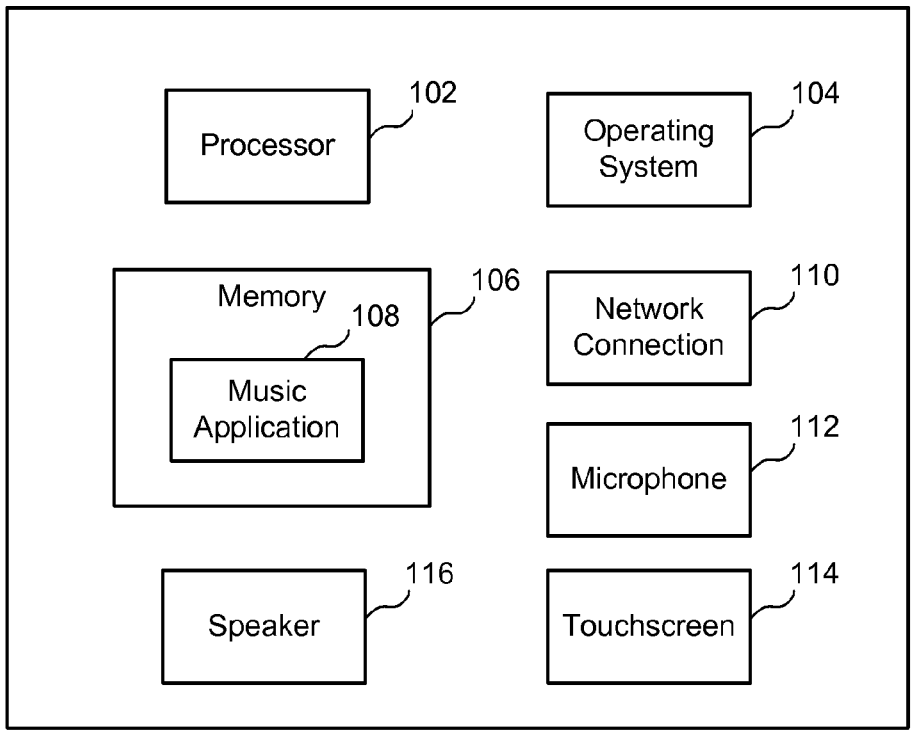
FIG. 1 is a block diagram of an example system, which may be used to implement the embodiments described herein.

FIG. 1 is a block diagram of an example system 100, which may be used to implement the embodiments described herein. In some embodiments, computer system 100 may include a processor 102, an operating system 104, a memory 106, a music application 108, a network connection 110, a microphone 112, a touchscreen 114, and a speaker 116. For ease of illustration, the blocks shown in FIG. 1 may each represent multiple units. In other embodiments, system 100 may not have all of the components shown and/or may have other elements including other types of elements instead of, or in addition to, those shown herein.

Music application 108 may be stored on memory 106 or on any other suitable storage location or computer-readable medium. Music application 108 provides instructions that enable processor 102 to perform the functions described herein. In various embodiments, music application 108 may run on any electronic device including smart phones, tablets, computers, etc.

In various embodiments, touchscreen 114 may include any suitable interactive display surface or electronic visual display that can detect the presence and location of a touch within the display area. Touchscreen 114 may support touching the display with a finger or hand, or any suitable passive object, such as a stylus. Any suitable display technology (e.g., liquid crystal display (LCD), light emitting diode (LED), etc.) can be employed in touchscreen 114. In addition, touchscreen 114 in particular embodiments may utilize any type of touch detecting technology (e.g., resistive, surface acoustic wave (SAW) technology that uses ultrasonic waves that pass over the touchscreen panel, a capacitive touchscreen with an insulator, such as glass, coated with a transparent conductor, such as indium tin oxide (ITO), surface capacitance, mutual capacitance, self-capacitance, projected capacitive touch (PCT) technology, infrared touchscreen technology, optical imaging, dispersive signal technology, acoustic pulse recognition, etc.).

In various embodiments, processor 102 may be any suitable processor or controller (e.g., a central processing unit (CPU), a general-purpose microprocessor, a microcontroller, a microprocessor, etc.). Further, operating system 104 may be any suitable operating system (OS), or mobile OS/platform, and may be utilized to manage operation of processor 102, as well as execution of various application software. Examples of operating systems include Android from Google, iPhone OS (iOS), Berkeley software distribution (BSD), Linux, Mac OS X, Microsoft Windows, and UNIX.

In various embodiments, memory 106 may be used for instruction and/or data memory, as well as to store music and/or video files created on or downloaded to system 100. Memory 106 may be implemented in one or more of any number of suitable types of memory (e.g., static random access memory (SRAM), dynamic RAM (DRAM), electrically erasable programmable read-only memory (EEPROM), etc.). Memory 106 may also include or be combined with removable memory, such as memory sticks (e.g., using flash memory), storage discs (e.g., compact discs, digital video discs (DVDs), Blu-ray discs, etc.), and the like. Interfaces to memory 106 for such removable memory may include a universal serial bus (USB), and may be implemented through a separate connection and/or via network connection 110.

In various embodiments, network connection 110 may be used to connect other devices and/or instruments to system 100. For example, network connection 110 can be used for wireless connectivity (e.g., Wi-Fi, Bluetooth, etc.) to the Internet (e.g., navigable via touchscreen 114), or to another device. Network connection 110 may represent various types of connection ports to accommodate corresponding devices or types of connections. For example, additional speakers (e.g., Jawbone wireless speakers, or directly connected speakers) can be added via network connection 110. Also, headphones via the headphone jack can also be added directly, or via wireless interface. Network connection 110 can also include a USB interface to connect with any USB-based device.

In various embodiments, network connection 110 may also allow for connection to the Internet to enable processor 102 to send and receive music over the Internet. As described in more detail below, in some embodiments, processor 102 may generate various instrument sounds coupled together to provide music over a common stream via network connection 110.

In various embodiments, speaker 116 may be used to play sounds and melodies generated by processor 102. Speaker 116 may also be supplemented with additional external speakers connected via network connection 110, or multiplexed with such external speakers or headphones.

Figure 2:
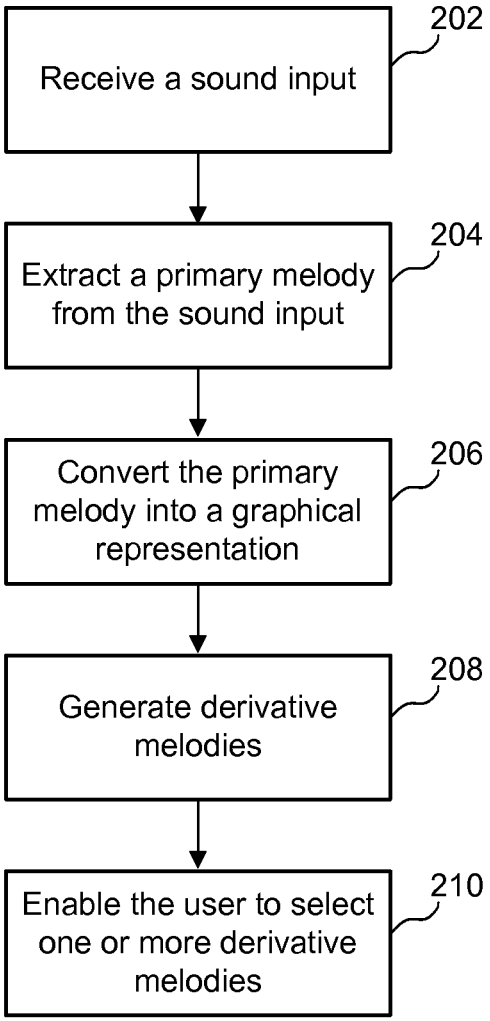
FIG. 2 illustrates an example simplified flow diagram for enhancing music, according to some embodiments.

FIG. 2 illustrates an example simplified flow diagram for enhancing music, according to some embodiments. Referring to both FIGS. 1 and 2, a method is initiated in block 202 where processor 102 receives a sound input. In various embodiments, the sound input may also be referred to as a sound seed, melodic seed, or seed. As described in more detail below, the sound input functions as a seed for generation of other sounds and melodies. Also, as described in more detail below, processor 102 may receive sounds via any suitable input device such as network connection 110, microphone 112, touchscreen 114, etc. Processor 102 may receive the sound input in various forms. For example, the sound input may include sounds waves, an audio file, musical notation, device input, etc.

In various embodiments, processor 102 receives the sound input in the form of sound waves (e.g., via microphone 112) provided by the user, where the sound may be a sound that is uttered by the user. For example, in some embodiments, the user may sing into microphone 112. The user may also whistle into microphone 112. The user may also speak into microphone 112, or play a musical instrument into microphone 112.

In various embodiments, processor 102 may receive the sound in the form of an audio file provided by the user. For example, in some embodiments, the user may provide an audio file containing music. In some embodiments, the audio file may contain premade melodies, rhythms, and/or lyric elements.

In various embodiments, processor 102 may receive the sound input in the form of musical notation. The musical notation may be stored in an electronic file, where processor 102 receives the electronic file and then extracts the musical notation. In some embodiments, the user may use a finger or a stylus to input a set of musical notations into any suitable input device such as touchscreen 114.

In some embodiments, processor 102 may receive the sound input via any suitable music device such as a musical keyboard. The musical keyboard may be a device that connects to network connection 110. The musical keyboard may also be a local application that uses touchscreen 114 to display a musical keyboard, notation, etc., and to receive sound input from the user. For example, in some embodiments, the musical keyboard may include at least an octave of a standard piano keyboard for playing the twelve notes of the Western musical scale, with a combination of larger, longer keys and smaller, shorter keys that repeats at the interval of an octave. Any number of keys is possible, depending on the specific implementation.

In block 204, processor 102 extracts a primary melody from the sound input. In various embodiments, the primary melody may be any linear succession of musical tones having a determined pitch and rhythm. Processor 102 may use any suitable algorithm to recognize and extract the primary melody from the sound input.

In block 206, processor 102 converts the primary melody into a graphical representation. The graphical representation may also be referred to as a melodic representation. Processor 102 may then cause the graphical representation to be displayed to the user. For example, processor 102 may cause the graphical representation to be displayed on the screen of a mobile device (e.g., screen of a cell phone, tablet, etc.), computer monitor, or any other suitable display device.

Figure 3:
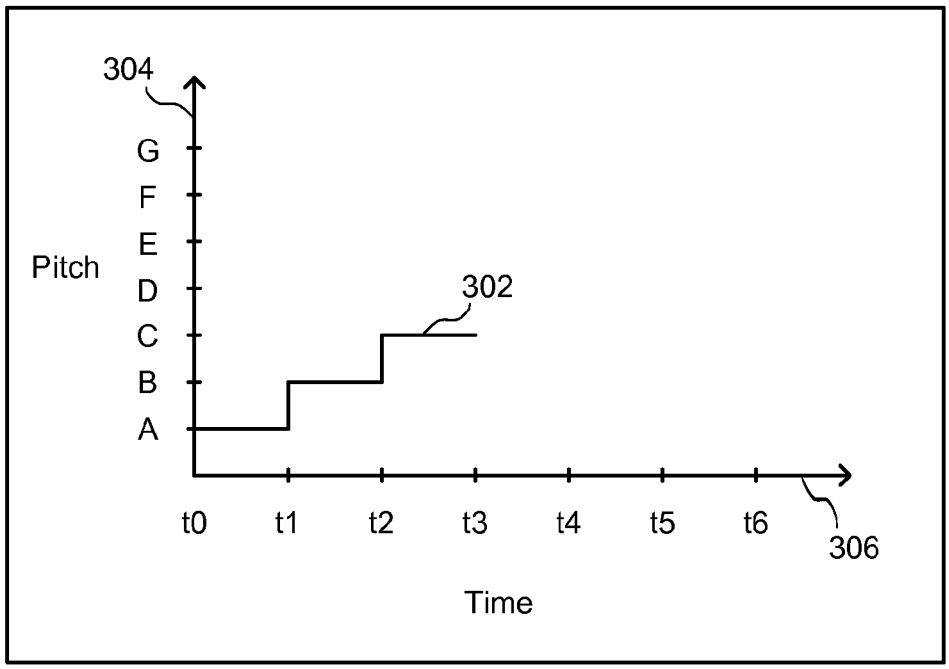
FIG. 3 illustrates an example simplified screen shot of a graphical representation of the primary melody, according to some embodiments.

FIG. 3 illustrates an example simplified screen shot of a graphical representation 300 of the primary melody 302, according to some embodiments. In various embodiments, the graphical representation may take various forms. For example, as shown, graphical representation 300 may include an x-axis 304 and a y-axis 306. In various embodiments, x-axis 304 may correspond to pitch, and y-axis 306 may correspond to time, where primary melody 302 has a form that is a graph of pitch with respect to time. For example, as shown, primary melody 302 may include a musical note A between time t0 and t1. Primary melody 302 may include a musical note B between time t1 and t2. Primary melody 302 may include a musical note C between time t2 and t3, etc.

For ease of illustration, a simple primary melody of three musical notes over three time periods are shown. Other primary melodies, and much more complex melodies are possible, depending on the specific implementation.

For further ease of illustration, primary melody 302 is shown as a simple form that includes a continuous line that changes over time. Various different forms are possible, depending on the specific implementation. For example, in some embodiments, processor 102 may generate a graphical representation that includes traditional musical notation or any other specific notation. For example, in some embodiments, processor 102 may generate a music staff of five horizontal lines and four spaces, which represent a musical pitch. Processor 102 may generate music symbols such as whole notes, half notes, quarter notes, etc., in appropriate positions on the music staff based on the primary melody.

In some embodiments, processor 102 may convert tones of primary melody 302 to combinations of positions, color, and shape of the icon. For example, each tone may be associated with a distinct color, such that the visual representation of the musical sequence is determined by a combination of position and color, where position along an axis determines the temporal arrangement of the notes and the color of the visual representation determines the pitch.

In some embodiments, processor 102 may convert tones of primary melody 302 to animations. For example, each tone may be represented as an animated humanoid figure. When the notes play, the animated figure may perform an action, such as a dance or mouth movement, when the associated tone is played.

Referring still to FIG. 3, in various embodiments, processor 102 may cause primary melody 302, when displayed, to dynamically change over time as processor 102 plays primary melody 302. For example, primary melody 302 may dynamically move from right to left while being played.

In some embodiments, processor 102 may correct one or more aspects of the primary melody. In various embodiments, such aspects may include pitch, rhythm, etc. In some embodiments, processor 102 may modify and/or improve primary melody 302 based on one or more music criteria. For example, processor 102 may correct pitch by reducing variability of pitches. In another example, processor 102 may correct rhythm by adjusting or snapping tones to a specific timing. In another example, processor 102 may adjust the primary melody by snapping it into a predetermined scale (e.g., key of C major). Processor 102 may use any suitable algorithms for correcting, smoothing, snapping, etc.

In various embodiments, at any time, processor 102 enables the user to play the primary melody. As described in more detail below, processor 102 enables the user to play the primary melody concurrently with user-specified derivative melodies thereby providing enhanced music.

In block 208, processor 102 generates derivative melodies, where each derivative melody is derived from the primary melody. As described in more detail below, processor 102 may generate derivative melodies based on various predetermined parameters. For example, such predetermined parameters may include pitch, time, quality, instruments, etc.

Figure 4:
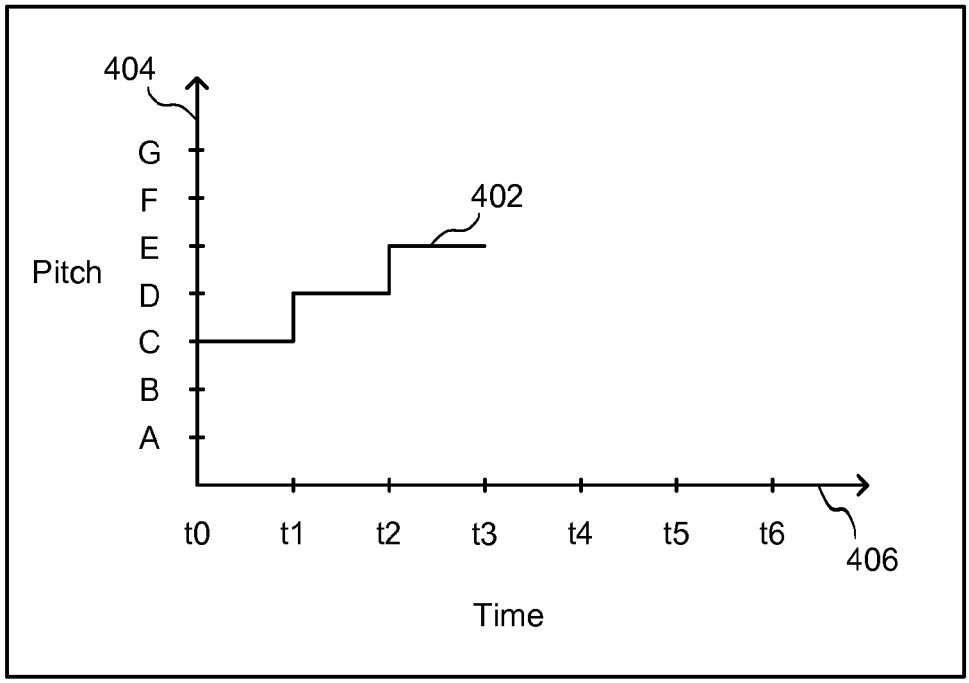
FIG. 4 illustrates an example simplified screen shot of a graphical representation of a derivative melody, according to some embodiments.

FIG. 4 illustrates an example simplified screen shot of a graphical representation 400 of a derivative melody 402, according to some embodiments. In some embodiments, the graphical representation of the derivative melody is similar to that of the primary melody. For example, as shown in this specific example, graphical representation 400 includes an x-axis 404 and a y-axis 406, where x-axis 404 may correspond to pitch, and y-axis 406 may correspond to time. Furthermore, primary melody 302 has a form that is a graph of pitch with respect to time.

In some embodiments, processor 102 may generate derivative melody 402 by shifting primary melody 302 pitch-wise. For example, as shown, derivative melody 402 may include a musical note C between time t0 and t1. Derivative melody 402 may include a musical note D between time t1 and t2. Derivative melody 402 may include a musical note E between time t2 and t3, etc.

Figure 5:
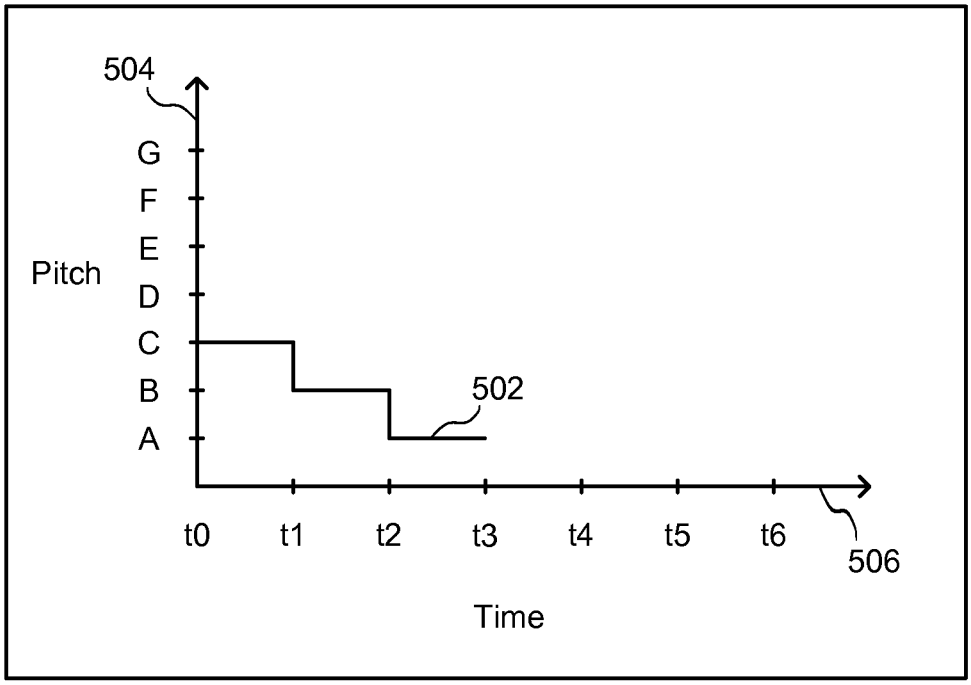
FIG. 5 illustrates an example simplified screen shot of a graphical representation of a derivative melody, according to some embodiments.

FIG. 5 illustrates an example simplified screen shot of a graphical representation 500 of a derivative melody 502, according to some embodiments. As shown, processor 102 may generate derivative melody 502 by flipping primary melody 302 (e.g., flipped upside down). For example, derivative melody 502 may include a musical note C between time t0 and t1. Derivative melody 502 may include a musical note B between time t1 and t2. Derivative melody 502 include a musical note A between time t2 and t3, etc.

Figure 6:
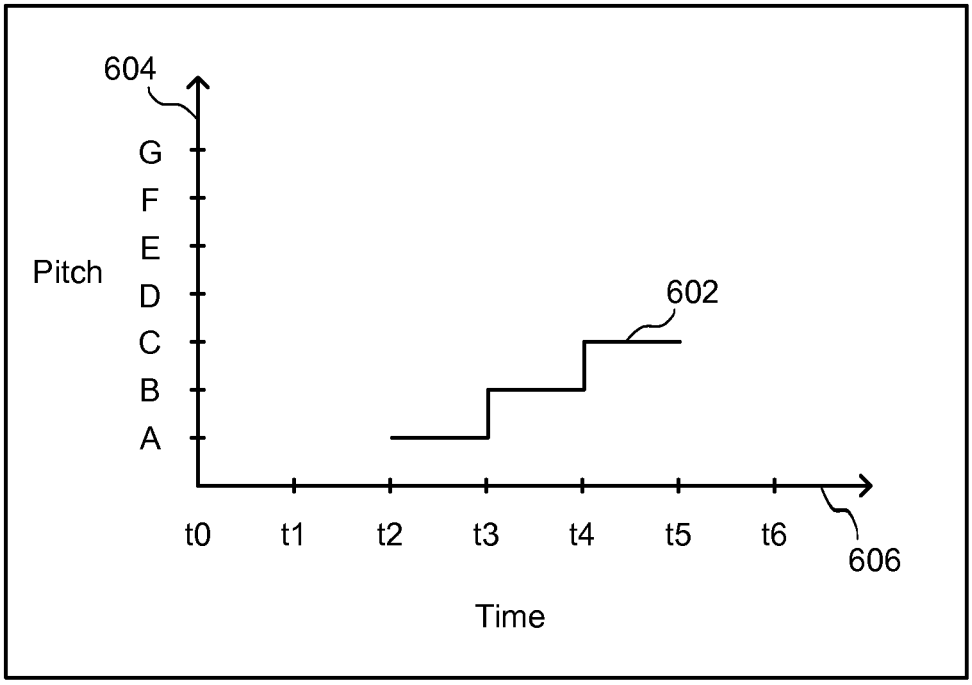
FIG. 6 illustrates an example simplified screen shot of a graphical representation of a derivative melody, according to some embodiments.

FIG. 6 illustrates an example simplified screen shot of a graphical representation 600 of a derivative melody 602, according to some embodiments. In some embodiments, processor 102 may generate derivative melody 602 by shifting primary melody 302 time-wise. For example, as shown, derivative melody 602 may include a musical note A between time t2 and t3. Derivative melody 402 may include a musical note B between time t3 and t4. Derivative melody 402 may include a musical note C between time t4 and t5, etc.

While three examples of derivative melodies are show in FIGS. 4, 5, and 6, others are possible, depending on the specific implementation. For example, processor 102 may generate a melody that includes the same note played repeatedly. As described in more detail below, processor 102 may play different melodies or voices using different musical instrument sounds. In the example of a same note played repeatedly, processor 102 could use the sound of a drum (e.g., bass drum, snare drum, tom, cymbal, etc.), or any other type of percussive instrument(s).

Referring again to FIG. 2, in block 210, processor 102 enables a user to select one or more of the derivative melodies to be played with the primary melody. In various embodiments, each derivative melody and/or each combination of derivative melodies enhances the primary melody when played concurrently. Processor 102 enables the user to share the enhanced music with others (e.g., friends, followers, etc.) via any communication system and/or social network system. In some embodiments, processor 102 may enable the user to play each derivative melody separately or to play combinations of derivative melodies. In some embodiments, processor 102 may enable the user to make one of the derivative melodies a primary melody. As such processor 102 may generate derivative melodies from the new primary melody, according to the embodiments described herein.

Figure 7:
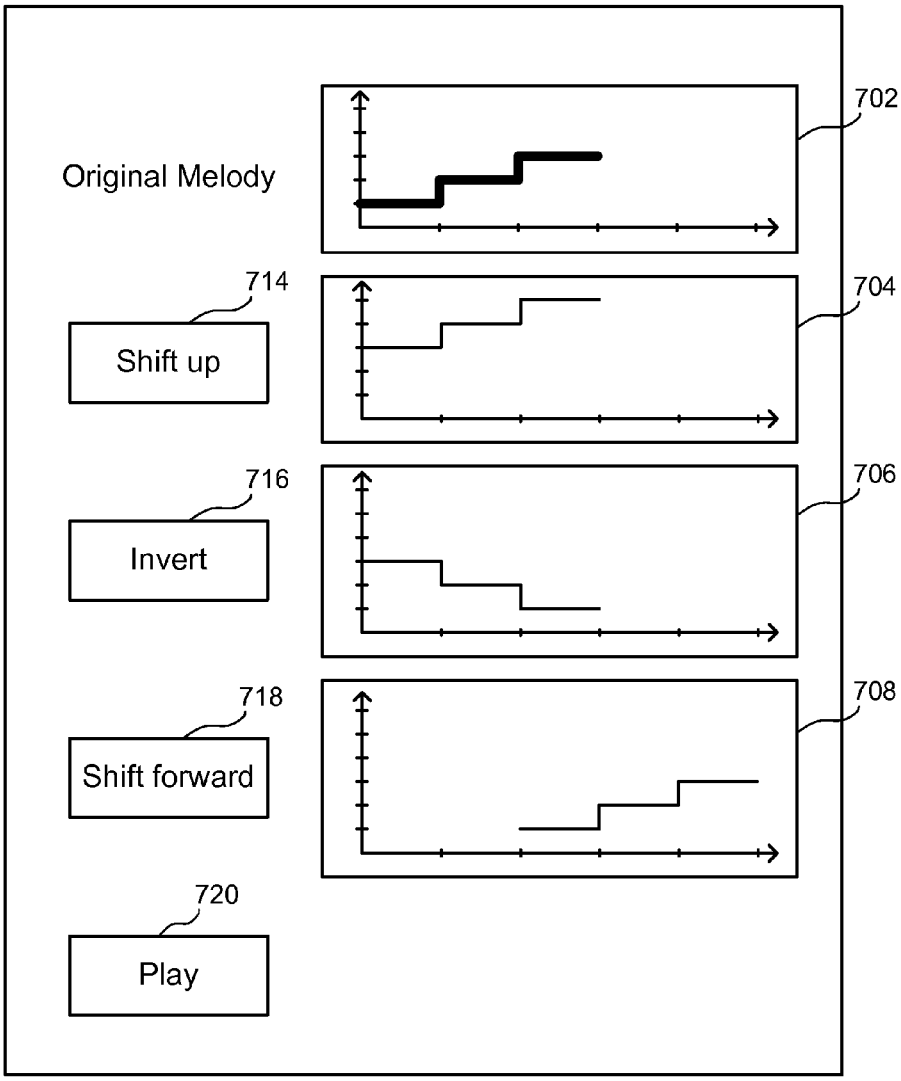
FIG. 7 illustrates an example simplified screen shot of a user interface, according to some embodiments.

FIG. 7 illustrates an example simplified screen shot of a user interface 700, according to some embodiments. As shown, user interface 700 displays a graphical representation 702 of a primary melody (labeled "Original"), a graphical representation 704 of a derivative melody (labeled "Shift up"), a graphical representation 706 of a derivative melody (labeled "Invert"), and a graphical representation 708 of a derivative melody (labeled "Shift forward").

In some embodiments, processor 102 may demarcate the primary melody in a variety of ways. For example, processor 102 may bold the graphical representation of the primary melody to distinguish it from the graphical representations of the derivative melodies, as shown. In some embodiments, processor 102 may color code the graphical representation of the primary melody differently from the graphical representations of the derivative melodies.

For ease of illustration, three derivative melodies are shown. Other derivative melodies are possible, depending on the specific implementation. In some embodiments, processor 102 may provide additional menus with more specific selections. For example, processor 102 may enable the user to select whether to shift a given primary melody up or down in pitch, and to select how many pitch levels to shift the primary melody. In some embodiments, processor 102 may provide the user with a selection for auto-harmonization. As such, if the user selects auto-harmonization, processor 102 may generate and play derivative melodies to provide chords and/or chord progressions.

In some embodiments, processor 102 may enable the user to select whether to shift a given primary melody forward or backward in time, to select how many beats or fractions of a beat to shift the primary melody, etc.

In various embodiments, each generated derivative may be referred to as a melody voice. In some embodiments, processor 102 may enable the user to select various melody voices and various qualities for each melody voice. In some embodiments, processor 102, may enable the user to select one or more corrections to pitch and/or rhythm.

In addition to menus, processor 102 may enable the user to select voices using one or more key presses, one or more vocal commands, one or more gestures, etc. For example, in some embodiments, processor 102 may enable the user to select and change a given selection by pressing a button. For example, if user selects any of buttons 714, 716, 718, etc., processor 102 may provide an entry field and/or drop-down menu (e.g., overlaying the button) with selections (e.g., shift up in pitch, shift down in pitch, invert, shift backward in time, shift forward in time, etc.). The menu selection may also include music styles, sound effects, etc. In some embodiments, once selected, processor 102 may replace the entry field and/or drop-down menu with a label indicating the selection, as shown.

In various embodiments, processor 102 may enable the user to select sets or suites of instruments to play the different voices in different music styles. For example, for a jazzy sound, processor 102 may generate an upright bass sound and/or bass drum sound for lower-pitch range voices, and various horn and/or string instrument sounds for mid- and upper-pitch range voices (can sound jazzy, rock, Japanese, etc.). For a rock sound, processor 102 may generate a bass drum sound and/or bass guitar sound for lower-pitch range voices, and various guitar and/or other instrument sound for mid- and upper-pitch range voices. For a classical sound, processor 102 may generate a wide range of instrument sounds. These are some examples of music sounds, and the particular selections will vary and depend on the specific implementation.

In some embodiments, processor 102 may enable the user to select particular keys for the voices. For example, processor 102 may generate selections for different major and minor keys (e.g., C major, A minor, etc.). Processor 102 may generate selections for different modes (e.g., mixolydian, dorian, etc.).

User interface 700 may also include a play button 720 to allow the user to play all voices together.

For ease of illustration, embodiments are described herein in the context of processor 102 receiving one sound input. Embodiments described herein also apply to processor 102 receiving multiple sound inputs, as well as multiple derivative melodies and other music enhancements associated with each extracted primary melody.

Embodiments described herein provide various benefits. For example, embodiments enable professional and non-professional musicians to quickly and conveniently record music and enhance such music. Embodiments also provide simple and intuitive selections for enhancing music.

Although the description has been described with respect to particular embodiments thereof, these particular embodiments are merely illustrative, and not restrictive. Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

A "processor" includes any suitable hardware and/or software system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems. A computer may be any processor in communication with a memory. The memory may be any suitable processor-readable storage medium, such as random-access memory (RAM), read-only memory (ROM), magnetic or optical disk, or other tangible media suitable for storing instructions for execution by the processor.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

We claim:

1. A method comprising:

receiving a sound input;

extracting a primary melody from the sound input;

converting the primary melody into a graphical representation;

generating a plurality of derivative melodies, wherein each derivative melody is derived from the primary melody; and enabling a user to select one or more of the derivative melodies to be played with the primary melody.

2. The method of claim 1, wherein the sound input is received in the form of sound waves.

3. The method of claim 1, wherein the sound input is received in the form of an audio file.

4. The method of claim 1, wherein the sound input is received in the form of musical notation.

5. The method of claim 1, wherein the method further comprises causing the graphical representation to be displayed to a user.

6. The method of claim 1, wherein the method further comprises causing the graphical representation to be displayed to a user, and wherein the graphical representation includes traditional musical notation.

7. The method of claim 1, wherein the method further comprises causing the graphical representation to be displayed to a user, and wherein the graphical representation includes colors and shapes.

8. The method of claim 1, wherein the method further comprises correcting one or more aspects of the primary melody.

9. A computer-readable storage medium carrying one or more sequences of instructions thereon, the instructions when executed by a processor cause the processor to perform operations comprising:

receiving a sound input;

extracting a primary melody from the sound input;

converting the primary melody into a graphical representation;

generating a plurality of derivative melodies, wherein each derivative melody is derived from the primary melody; and enabling a user to select one or more of the derivative melodies to be played with the primary melody.

10. The computer-readable storage medium of claim 9, wherein the sound input is received in the form of sound waves.

11. The computer-readable storage medium of claim 9, wherein the sound input is received in the form of an audio file.

12. The computer-readable storage medium of claim 9, wherein the sound input is received in the form of musical notation.

13. The computer-readable storage medium of claim 9, wherein the instructions further cause the processor to perform operations comprising causing the graphical representation to be displayed to a user.

14. The computer-readable storage medium of claim 9, wherein the instructions further cause the processor to perform operations comprising causing the graphical representation to be displayed to a user, and wherein the graphical representation includes traditional musical notation.

15. The computer-readable storage medium of claim 9, wherein the instructions further cause the processor to perform operations comprising causing the graphical representation to be displayed to a user, and wherein the graphical representation includes colors and shapes.

16. The computer-readable storage medium of claim 9, wherein the instructions further cause the processor to perform operations comprising correcting one or more aspects of the primary melody.

17. An apparatus comprising:

one or more processors; and logic encoded in one or more tangible media for execution by the one or more processors, and when executed operable to perform operations comprising:

receiving a sound input;

extracting a primary melody from the sound input;

converting the primary melody into a graphical representation;

generating a plurality of derivative melodies, wherein each derivative melody is derived from the primary melody; and enabling a user to select one or more of the derivative melodies to be played with the primary melody.

18. The apparatus of claim 17, wherein the sound input is received in the form of sound waves.

19. The apparatus of claim 17, wherein the sound input is received in the form of an audio file.

20. The apparatus of claim 17, wherein the sound input is received in the form of musical notation.

* * * * *